US010241434B2

(12) United States Patent
Araki et al.

(10) Patent No.: US 10,241,434 B2
(45) Date of Patent: Mar. 26, 2019

(54) IMAGE FORMING APPARATUS AND POSITION DETECTION METHOD

(71) Applicant: CANON KABUSHIKI KAISHA, Tokyo (JP)

(72) Inventors: Ryuichi Araki, Funabashi (JP); Kazuhisa Koizumi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/728,683

(22) Filed: Oct. 10, 2017

(65) Prior Publication Data

US 2018/0107131 A1 Apr. 19, 2018

(30) Foreign Application Priority Data

Oct. 13, 2016 (JP) ..... 2016-201618

(51) Int. Cl.
*G03G 15/00* (2006.01)
*G03G 15/01* (2006.01)

(52) U.S. Cl.
CPC ..... *G03G 15/0131* (2013.01); *G03G 15/5058* (2013.01); *G03G 15/6561* (2013.01); *G03G 2215/0161* (2013.01)

(58) Field of Classification Search
USPC ..... 399/39–41, 49, 301, 302; 358/3.26; 356/400, 614, 615
See application file for complete search history.

(56) References Cited

U.S. PATENT DOCUMENTS

| | | | | |
|---|---|---|---|---|
| 7,929,892 | B2 * | 4/2011 | Ogawa | G03G 15/0131 399/301 |
| 8,179,569 | B2 * | 5/2012 | Kageyama | G03G 15/0194 358/1.9 |
| 8,355,643 | B2 * | 1/2013 | Kojima | G03G 15/5041 399/231 |
| 2010/0021196 | A1 * | 1/2010 | Atsumi | G03G 15/5041 399/74 |

FOREIGN PATENT DOCUMENTS

| | | | | |
|---|---|---|---|---|
| JP | H10260567 | A | 9/1998 | |
| JP | 2010048904 | A | 3/2010 | |
| JP | 2015090460 | A * | 5/2015 | G03G 15/01 |

OTHER PUBLICATIONS

English machine-translation of JP-2010048904.*

* cited by examiner

*Primary Examiner* — Walter L Lindsay, Jr.
*Assistant Examiner* — Arlene Heredia
(74) *Attorney, Agent, or Firm* — Rossi, Kimms & McDowell LLP

(57) ABSTRACT

An image forming apparatus includes a photo sensor, which is configured to detect a measurement image formed on an intermediate transfer belt, and a controller. The controller includes a first comparator, a second comparator, an XOR unit, and a CPU. The first comparator is configured to binarize an analog detection waveform, which represents a detection result of a measurement image by the photo sensor, in accordance with a first threshold value to generate a first binary signal. The second comparator is configured to binarize the detection waveform in accordance with a second threshold value to generate a second binary signal. The XOR unit is configured to perform an XOR operation in accordance with the first binary signal and the second binary signal to generate an XOR signal.

9 Claims, 8 Drawing Sheets

| Δd | α |
|---|---|
| d 1 | α 1 |
| d 2 | α 2 |
| d 3 | α 3 |
| d 4 | α 4 |
| d 5 | α 5 |
| ⋮ | ⋮ |
| d x | α x |

FIG. 7

IMAGE FORMING APPARATUS AND POSITION DETECTION METHOD

BACKGROUND OF THE INVENTION

Field of the Invention

The present invention relates to an image forming apparatus such as a copying machine and a printer.

Description of the Related Art

An image forming apparatus configured to perform color printing forms a color image, for example, by forming images of different colors on four independent image bearing members, respectively, and superimposing the images of respective colors on one another. For such an image forming apparatus, it is important that the images of respective colors are superimposed on one another without misregistration. However, individual differences of components and variation at the time of assembly may cause the misregistration of the images of respective colors. Such misregistration of the images of respective colors is referred to as "color misregistration." An image forming apparatus typically has a configuration for correcting the color misregistration.

Color misregistration correction is performed in the following manner. For example, measurement images for use in detection of the color misregistration are formed for respective colors, and color misregistration amounts are measured based on formation positions of the measurement images of respective colors. Then, the color misregistration correction is performed based on the measured color misregistration amounts. The formation positions of the measurement images are detected by an optical sensor. The optical sensor irradiates light to the measurement images and receives reflected light from the measurement images to detect formation positions of the measurement images. In Japanese Patent Application Laid-open No. 10-260567 and Japanese Patent Application Laid-open No. 2010-048904, image forming apparatus each having a configuration for the color misregistration correction are disclosed. Both of the disclosed image forming apparatus have a configuration for accurate detection of the color misregistration amounts.

An image density at an end portion of the measurement image may be changed depending on degradation in durability of the configuration for image formation or depending on image forming conditions. For example, when the image formation is performed using an image bearing member of a drum type, the change in image density may occur at a rear end of the measurement image in a rotation direction of a drum. In the related-art image forming apparatus, such a phenomenon may cause an error between an actual formation position of the measurement image and a formation position of the measurement image based on a detection result given by the optical sensor. The error in formation positions may hinder highly accurate color misregistration correction. Therefore, the present invention has an object to provide an image forming apparatus, which is capable of detecting formation positions of images with high accuracy for highly accurate color misregistration correction even when an image density of a measurement image changes.

SUMMARY OF THE INVENTION

An image forming apparatus, which is configured to form an image on a sheet, comprising: a plurality of image forming units configured to form a plurality of images, each having a different color; a sensor configured to measure reflected light from a color pattern formed on a transfer member, the color pattern being used for detection of a color misregistration amount; a first comparator configured to compare a measurement value of the sensor with a first threshold value; a second comparator configured to compare the measurement value of the sensor with a second threshold value being different from the first threshold value; and a controller configured to control the plurality of image forming units to form, on the transfer member, a plurality of color patterns, each having a different color, control the sensor to measure reflected light from the plurality of color patterns, cause the first comparator to compare measurement values of reflected light from the plurality of color patterns with the first threshold value to acquire first data, cause the second comparator to compare the measurement values of reflected light from the plurality of color patterns with the second threshold value to acquire second data, detect the color misregistration amount related to relative position of a color pattern having a reference color among the plurality of color patterns and a color pattern having another color among plurality of color patterns based on the first data and the second data, and determine an image forming condition for adjusting an image forming position of an image having other color different from the reference color based on the color misregistration amount, wherein the controller generates correction data based on the first data and the second data, and detects the color misregistration amounts based on the second data and the correction data.

Further features of the present invention will become apparent from the following description of exemplary embodiments (with reference to the attached drawings).

BRIEF DESCRIPTION OF THE DRAWINGS

FIG. 7 is an example of a table.

DESCRIPTION OF THE EMBODIMENTS

An embodiment of the present invention is described below in detail with reference to the drawings.

Overall Structure

Figure 1:
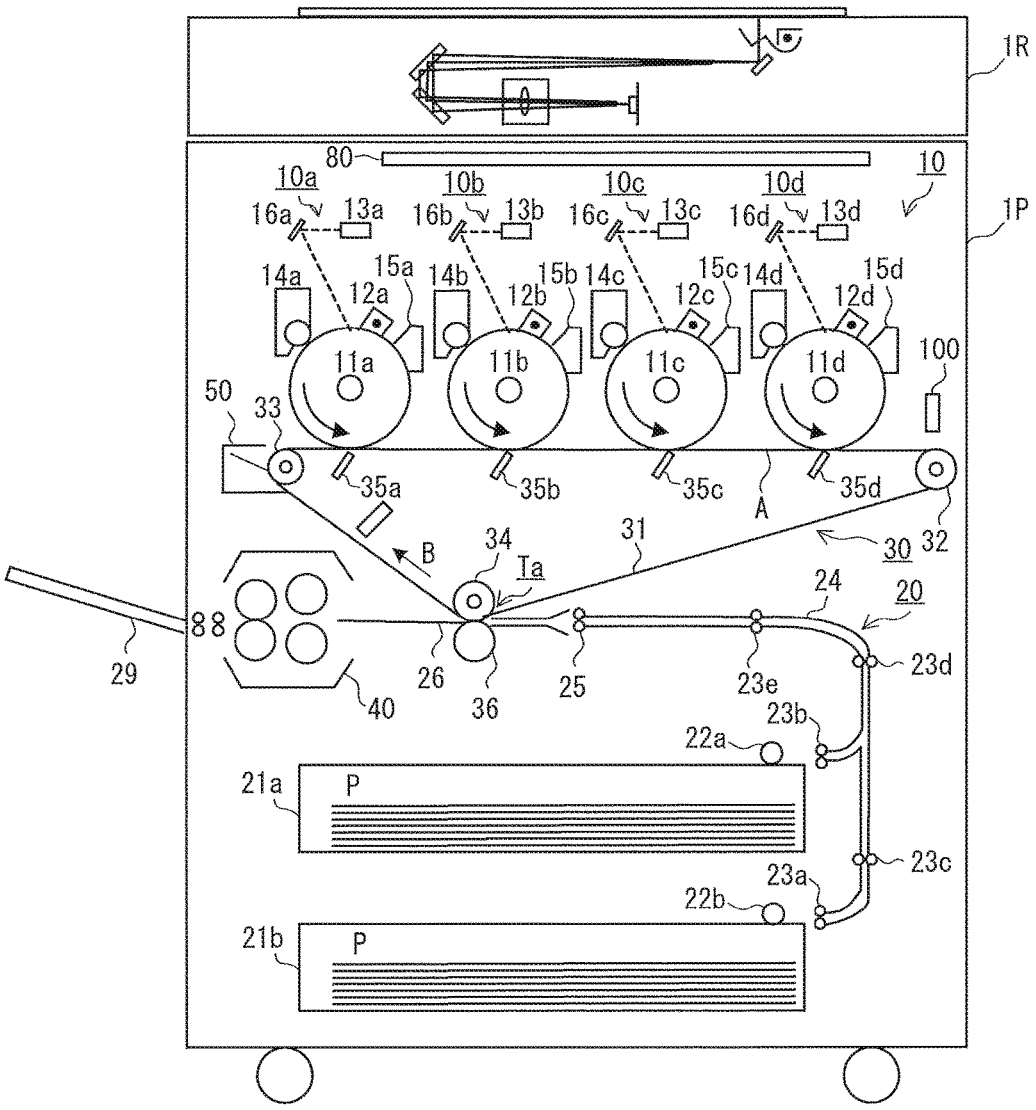
FIG. 1 is a configuration view of an image forming apparatus.

FIG. 1 is a configuration view of an image forming apparatus according to this embodiment. The image forming apparatus is configured to form a plurality of images of different colors by an electrophotographic method, for example.

The image forming apparatus includes a reader 1R and a printer 1P. The reader 1R is configured to read an image from an original and generate an image signal being an electric signal representing the read image. The reader 1R transmits the generated image signal to the printer 1P. The printer 1P is configured to form an image, which is based on the image signal, on a recording material P such as a sheet. The printer 1P may acquire the image signal from the reader 1R, or from an external device such as a personal computer through a network.

The printer 1P includes an image forming unit 10, a feeding unit 20, an intermediate transfer unit 30, a fixing device 40, a cleaning unit 50, photo sensors 100, and a controller 80. The image forming unit 10 includes four image forming units 10*a*, 10*b*, 10*c*, and 10*d* being arrayed. The image forming units 10*a* to 10*d* are different only in colors of images to be formed, and have the same configuration. The image forming unit 10*a* is configured to form an image of yellow (Y). The image forming unit 10*b* is configured to form an image of magenta (M). The image forming unit 10*c* is configured to form an image of cyan (C). The image forming unit 10*d* is configured to form an image of black (K). The colors of images to be formed by the image forming units 10*a* to 10*d* are mere examples and are not limited to the above-mentioned colors. Herein, description is made of a configuration of the image forming unit 10*a*, and description as to configurations of other image forming units 10*b* to 10*d* is omitted.

The image forming unit 10*a* includes a drum-type photosensitive member (photosensitive drum 11*a*) being an image bearing member. The photosensitive drum 11*a* is driven to rotate about a shaft of the drum in a counterclockwise direction in FIG. 1. In a periphery of the photosensitive drum 11*a*, there are provided a charging device 12*a*, a laser scanner 13*a*, a developing device 14*a*, and a cleaner 15*a* along the rotation direction of the photosensitive drum 11*a*.

The charging device 12*a* uniformly charges a surface of the photosensitive drum 11*a*. The laser scanner 13*a* irradiates a light beam, such as a laser beam that is modulated in accordance with an image signal through a control executed by the controller 80, to the photosensitive drum 11*a* through reflection on a reflection mirror 16*a*. The light beam is irradiated to the photosensitive drum 11*a* after the surface of the photosensitive drum 11*a* is charged, thereby forming an electrostatic latent image in accordance with the image signal on the surface of the photosensitive drum 11*a*. The developing device 14*a* allows yellow developer to adhere to the electrostatic latent image formed on the photosensitive drum 11*a*, thereby developing the electrostatic latent image and forming a visible image on the photosensitive drum 11*a*. The developing device 14*b* allows magenta developer to adhere to an electrostatic latent image formed on the photosensitive drum 11*b*, thereby developing the electrostatic latent image. The developing device 14*c* allows cyan developer to adhere to an electrostatic latent image formed on the photosensitive drum 11*c*, thereby developing the electrostatic latent image. The developing device 14*d* allows black developer to adhere to an electrostatic latent image formed on the photosensitive drum 11*d*, thereby developing the electrostatic latent image.

The intermediate transfer unit 30 includes an intermediate transfer belt 31 being an intermediate transfer member, a drive roller 32, a roller 33, a secondary transfer inner roller 34, and primary transfer units 35*a* to 35*d*. The intermediate transfer belt 31 is an image bearing member, which is stretched around the drive roller 32, the roller 33, and the secondary transfer inner roller 34 and is driven to rotate in the direction of the arrow B in FIG. 1 by the drive roller 32. The primary transfer units 35*a* to 35*d* are associated with the photosensitive drums 11*a* to 11*d*, respectively. The primary transfer units 35*a* to 35*d* are provided so as to sandwich the intermediate transfer belt 31 with the associated photosensitive drums 11*a* to 11*d*. The primary transfer units 35*a* to 35*d* transfers the visible images, which are formed on the associated photosensitive drums 11*a* to 11*d*, onto the intermediate transfer belt 31. With this, the visible images of respective colors are formed on the intermediate transfer belt 31. The developer, which remains on the photosensitive drums 11*a* to 11*d* after the transfer, is removed by cleaners 15*a* to 15*d*.

The secondary transfer inner roller 34 forms a secondary transfer unit Ta with a secondary transfer outer roller 36. At the secondary transfer unit Ta, the recording material P, which is conveyed by the feeding unit 20, and the intermediate transfer belt 31 are sandwiched and conveyed between the secondary transfer inner roller 34 and the secondary transfer outer roller 36. With this action, at the secondary transfer unit Ta, the visible images formed on the intermediate transfer belt 31 are collectively transferred onto the recording material P. The cleaning unit 50 removes the developer which remains on the intermediate transfer belt 31 after the transfer.

The feeding unit 20 includes sheet cassettes 21*a* and 21*b*, pickup rollers 22*a* and 22*b*, conveyance rollers 23*a* to 23*e*, a conveyance passage 24, and registration rollers 25. The sheet cassettes 21*a* and 21*b* receive the recording material P. The recording material P is fed one after another by the pickup rollers 22*a* and 22*b* from the sheet cassettes 21*a* and 21*b*. The fed recording material P is conveyed by the conveyance rollers 23*a* to 23*e* through the conveyance passage 24 to the registration rollers 25. The registration rollers 25 correct, for example, skew feed of the recording material P and convey the recording material P to the secondary transfer unit Ta at a timing matching with conveyance of the visible images, which are formed on the intermediate transfer belt 31, to the secondary transfer unit Ta.

The recording material P having the visible images transferred thereto at the secondary transfer unit Ta is conveyed through the conveyance passage 26 to the fixing device 40. The fixing device 40 fixes the visible images on the recording material P through application of heat and pressure to the recording material P. After the visible images are fixed, the image forming processing to the recording material P is terminated. The recording material P having an image formed thereon is delivered from the fixing device 40 to a tray 29.

The image forming apparatus having the above-mentioned configuration includes photo sensors 100 in the vicinity of the intermediate transfer belt 31. The photo sensors 100 are used for position detection and image density detection with respect to the visible images borne on the intermediate transfer belt 31. On the intermediate transfer belt 31, measurement images (color patterns) for the position detection are formed at the time of the position detection with respect to the visible images, and measurement images for the image density detection are formed at the time of the image density detection. Therefore, the photo sensors 100 are provided between the image forming unit 10 and the secondary transfer unit Ta in the rotation direction of the intermediate transfer belt 31.

Measurement of Measurement Images

Figure 2:
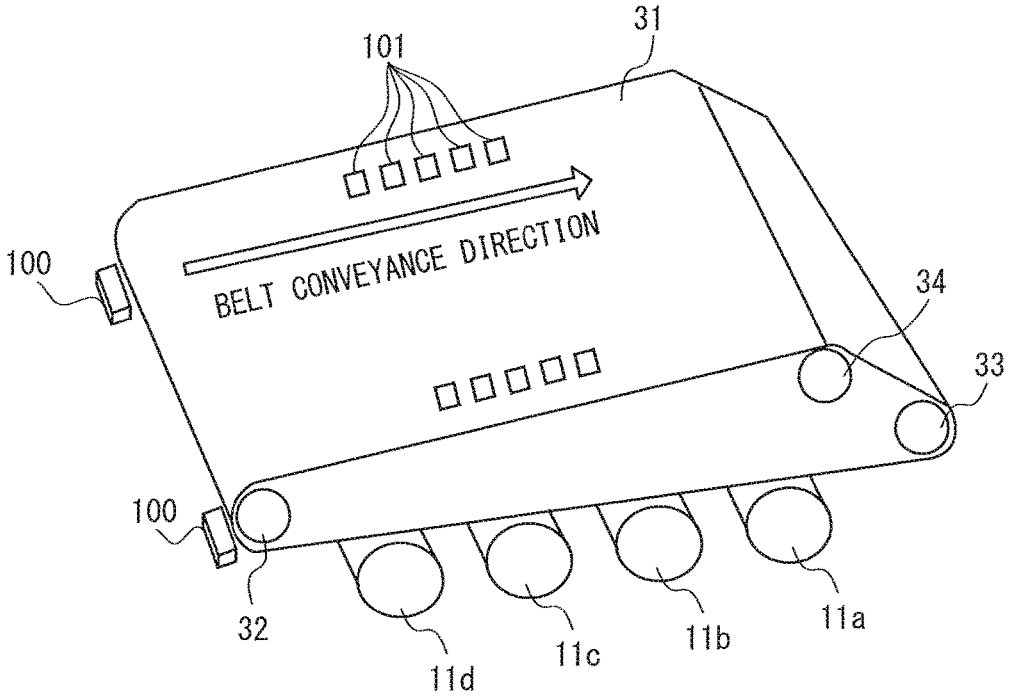
FIG. 2 is a view for illustrating an intermediate transfer unit as seen from a feeding unit side.

FIG. 2 is a view for illustrating the intermediate transfer unit 30 as seen from the feeding unit 20 side. The photo sensors 100 irradiate light to the intermediate transfer belt 31 and detect measurement images 101 based on reflected light. A detection result includes information related to misregistration and image density. In this embodiment, the measurement images 101 are formed at both ends in a direction orthogonal to a conveyance direction (rotation direction) of the intermediate transfer belt 31. Therefore, the photo sensors 100 are arranged at two locations, that is, at both ends in the direction orthogonal to the conveyance direction of the intermediate transfer belt 31 so as to correspond to the two measurement images. The measurement images 101 of respective colors Y, M, C, and K are formed on the intermediate transfer belt 31 so as not to overlap with each other. In this embodiment, the measurement images 101 are formed in the order of Y, M, C, and K from the top in the conveyance direction of the intermediate transfer belt 31.

Figure 3A:
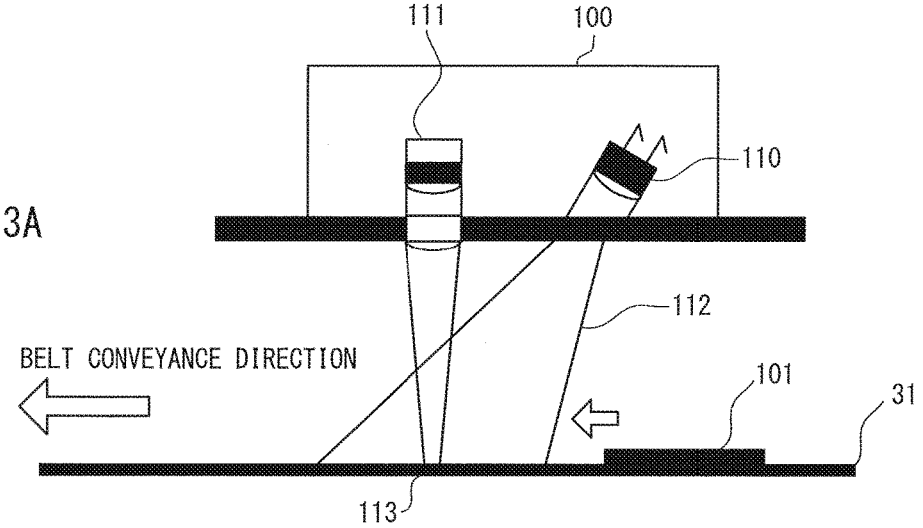
FIG. 3A, FIG. 3B, FIG. 3C, and FIG. 3D are explanatory illustrations of a photo sensor.

FIG. 3A to FIG. 3D are explanatory illustrations of the photo sensor 100. As illustrated in FIG. 3A, the photo sensors 100 are each an optical sensor including a light emitting unit 110 and a light receiving unit 111. The light emitting unit 110 is constructed by, for example, a light emitting diode (LED). The light receiving unit 111 is constructed by, for example, a photo diode. The light emitting unit 110 irradiates light to the intermediate transfer belt 31. The light receiving unit 111 receives the light which is irradiated from the light emitting unit 110 and reflected on the intermediate transfer belt 31. A light irradiation area 112 of light irradiated by the light emitting unit 110 includes alight reception area 113 in which the light receiving unit 111 receives the reflected light. The light receiving unit 111 performs photoelectric conversion with respect to the reflected light having been received and outputs an electric signal in accordance with an amount of reflected light. The electric signal output from the light receiving unit 111 is an analog signal which is changed in value in accordance with the amount of reflected light.

The light receiving unit 111 of the photo sensor 100 of this embodiment is arranged at a position of receiving diffused light. The light irradiated from the light emitting unit 110 is separated into specularly reflected light and diffused reflected light when the light is reflected on an object subjected to the irradiation. A ratio of the specularly reflected light and the diffused reflected light differs in accordance with the object subjected to the irradiation. In this embodiment, the intermediate transfer belt 31 is made of a material exhibiting, in the light reflected on the same, a larger ratio of the specularly reflected light and a smaller ratio of the diffused reflected light. The measurement images 101 are formed with developer exhibiting, in the light reflected on the same, a smaller ratio of the specularly reflected light and a larger ratio of the diffused reflected light. Therefore, the analog signal output from the light receiving unit 111 has a smaller value in a case of receiving the reflected light from the intermediate transfer belt 31 and has a larger value in a case of receiving reflected light from the measurement images 101.

Figure 3B:
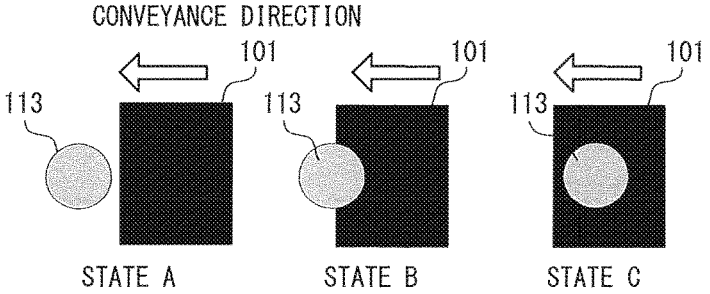
Figure 3C:
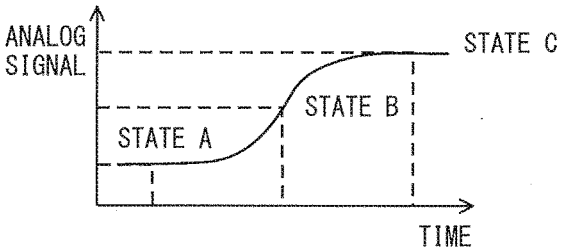
Figure 3D:
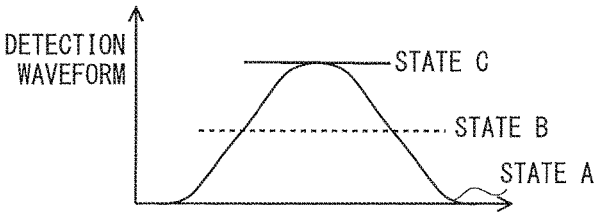

FIG. 3B to FIG. 3D are illustrations of a relationship between the measurement image 101 passing through the light reception area 113 and a detection waveform of the analog signal output from the light receiving unit 111. A state A is a state before conveyance of the measurement image 101 to the light reception area 113. In this case, the light receiving unit 111 receives only the reflected light from the intermediate transfer belt 31. A state B is a state in a course of entry of the measurement image 101 into the light reception area 113. In this case, the light receiving unit 111 receives reflected light from the intermediate transfer belt 31 and reflected light from the measurement image 101. A state C is a state in which the measurement image 101 has completely entered the light reception area 113. In this case, the light receiving unit 111 receives only the reflected light from the measurement image 101.

The amount of diffused reflected light received by the light receiving unit 111 increases as a ratio of the measurement image 101 to the light reception area 113 increases. Therefore, in accordance with the ratio of the measurement image to the light reception area 113, the value of the analog signal output from the light receiving unit 111 increases. As exemplified in FIG. 3C, a value of the analog signal is smallest in the state A, and a value of the analog signal is largest in the state C. As the state shifts from the state A to the state C, the value of the analog signal is linearly changed in accordance with the ratio of the measurement image 101 to the light reception area 113. The measurement image 101 is conveyed by the intermediate transfer belt 31 to pass through the light reception area 113. Therefore, the relationship between the measurement image 101 and the light reception area 113 is changed in the order of the state A, the state B, the state C, the state B, and the state A. Thus, the detection waveform of the analog signal forms a mountain-like shape as illustrated in FIG. 3D in accordance with the change in value. The measurement image 101 is conveyed at constant speed along with the rotation of the intermediate transfer belt 31. Therefore, the detection waveform of the analog signal output from the light receiving unit 111 is symmetrical over a center of the measurement image 101.

Figure 4A:
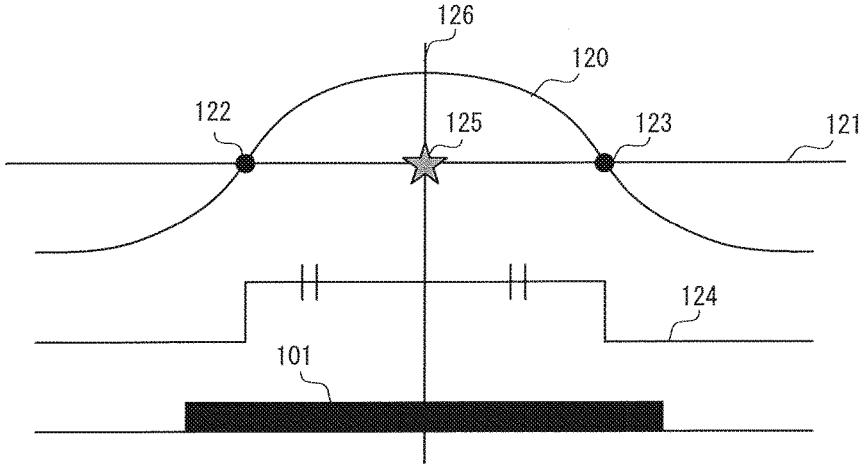
FIG. 4A, FIG. 4B, and FIG. 4C are explanatory diagrams for illustrating detection of a formation position of a measurement image.
Figure 4B:
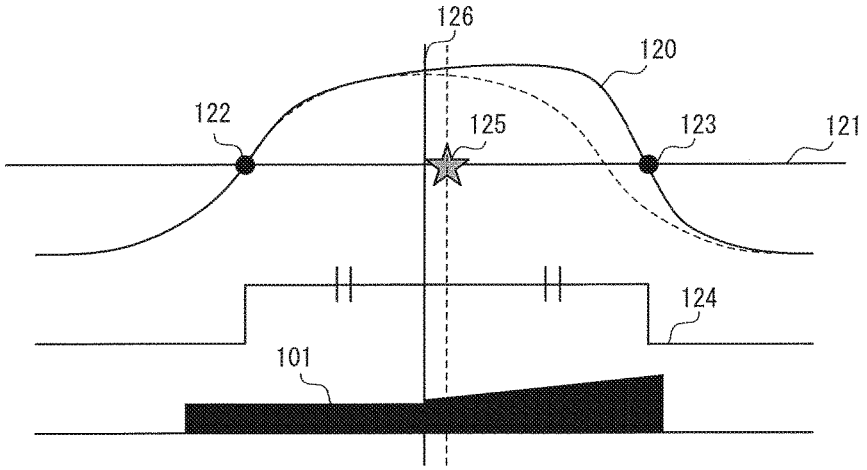
Figure 4C:
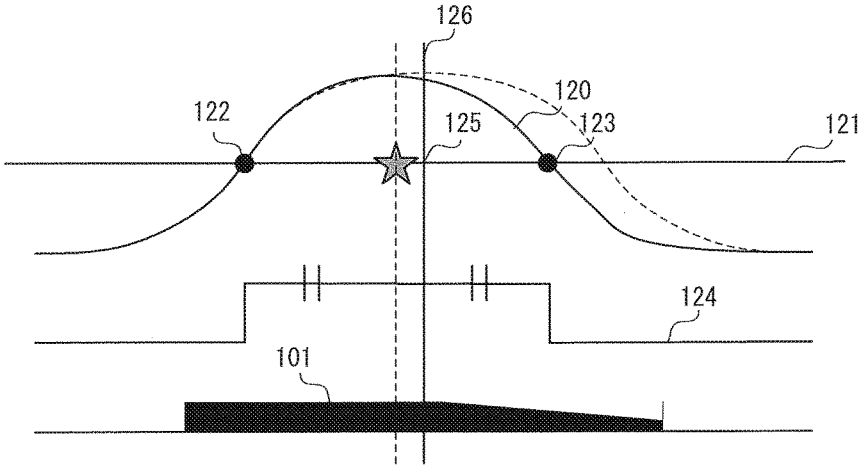

FIG. 4A to FIG. 4C are explanatory diagrams for illustrating detection of a formation position of the measurement image 101. The formation position of the measurement image 101 is detected by a detection waveform 120 being a measurement result of the measurement image by the light receiving unit 111. As illustrated in FIG. 4A, the detection waveform 120 is binarized in accordance with a predetermined threshold value 121 and converted into a binary signal 124. An intermediate position (gravity center position 125) between a rising edge 122 and a falling edge 123 of the binary signal 124 is detected as the formation position of the measurement image 101. In this case, an actual formation position 126, that is, a lengthwise center of the measurement image 101 in the conveyance direction matches with the gravity center position 125. The formation position of the measurement image 101 is detected based on the gravity center position 125 of the detection waveform 120. Therefore, the formation positions of the measurement images of respective colors are detected without being dependent on the changes in image density of the measurement images 101 of respective colors. Thus, the color misregistration amount can be detected without an error regardless of the density differences of the measurement images 101 of respective colors Y, M, C, and K.

When the measurement image 101 has an even image density, the detection waveform 120 is symmetrical. Therefore, the formation position of the measurement image 101 is accurately detected by the binary signal 124. However, when the measurement image 101 has an uneven image density, there may occur an error between the gravity center position 125 detected from the detection waveform 120 and the actual formation position 126 of the measurement image 101.

Degradation in durability and image forming conditions of the image forming unit 10 may cause changes in image density at the end portion of the measurement image 101. For example, there is a case in which the image density of the measurement image 101 is changed on a rear end side in the rotation direction of the photosensitive drum 11*a*, that is, on the rear end side in the conveyance direction of the intermediate transfer belt 31. In this case, as illustrated in FIG. 4B and FIG. 4C, there occurs an error between the gravity center position 125 detected from the detection waveform 120 and the actual formation position 126 of the measurement image 101.

FIG. 4B is an illustration of a case in which the image density is larger on the rear end side of the measurement image 101. In this case, the detection waveform 120 has a larger measurement value on the rear end side of the measurement image 101. Therefore, the detection waveform 120 is asymmetrical. When the detection waveform 120 is converted into the binary signal 124, and the gravity center position 125 of the binary signal 124 is detected as the formation position of the measurement image 101, there occurs an error from the actual formation position 126 of the measurement image 101. FIG. 4C is an illustration of a case in which the measurement image 101 has a smaller image density on the rear end side. In this case, there occurs an error in a direction reverse to that of FIG. 4B. As described above, when the measurement image 101 has an image density which is changed at an end portion thereof, accurate detection for the formation position is not performed. Therefore, the color misregistration correction cannot be performed with high accuracy.

Controller

Figure 5:
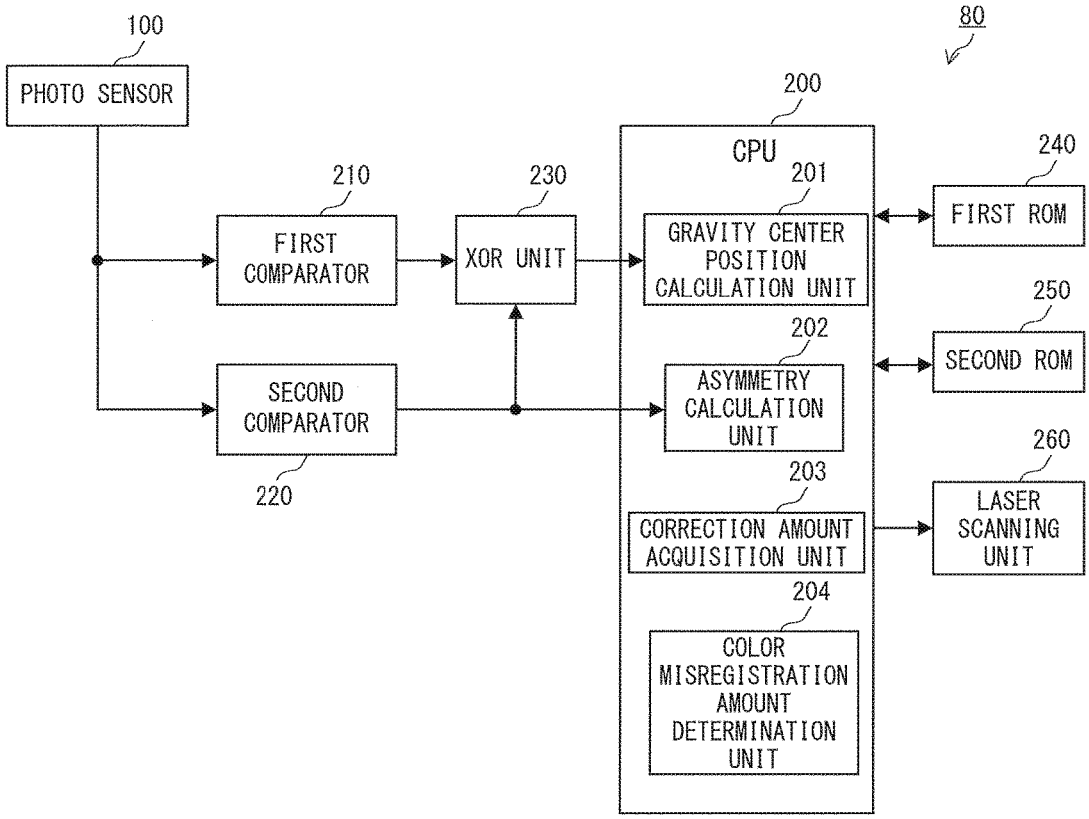
FIG. 5 is a configuration diagram of a controller.

FIG. 5 is a configuration diagram of the controller 80. The controller 80 is configured to execute an operation control for the image forming apparatus. Herein, description is made only of a configuration of the controller 80 for performing the color misregistration correction, and description of other configuration is omitted. The controller 80 is constructed by, for example, a system-on-a-chip (SOC) or an application-specific integrated circuit (ASIC).

The controller 80 is a computer including a central processing unit (CPU) 200. The CPU 200 reads a computer program from a memory (not shown) and executes the read computer program to control an operation of the image forming apparatus. Further, the controller 80 includes a first comparator 210, a second comparator 220, an XOR unit 230, a first ROM 240, a second ROM 250, and a laser scanning unit 260.

The first comparator 210 and the second comparator 220 acquire analog signals from the photo sensors 100 and convert the read analog signals into binary signals. The first comparator 210 and the second comparator 220 have different threshold values for conversion of the analog signals into the binary signals. In this embodiment, a first threshold value set for the first comparator 210 is larger than a second threshold value set for the second comparator 220. However, it is possible to set a first threshold value for the first comparator 210 to be smaller than a second threshold value set for the second comparator 220. The first comparator 210 outputs a first binary signal, and the second comparator 220 outputs a second binary signal. The first binary signal output from the first comparator 210 is input to the XOR unit 230. The second binary signal output from the second comparator 220 is input to the XOR unit 230 and to the CPU 200.

The XOR unit 230 performs an exclusive OR operation with input of the first binary signal and the second binary signal. The XOR unit 230 inputs an exclusive OR signal (XOR signal), which is acquired as a result of the exclusive OR operation, to the CPU 200.

In this embodiment, the measurement images of respective colors Y, M, C, and K are sequentially formed on the intermediate transfer belt 31 at predetermined time intervals T. The formation positions of the measurement images of respective colors are expressed by time points at which the measurement images of M, C, and K are detected with the timing of detection of the measurement image of Y as a reference. For example, when the formation position of the measurement image of M is expressed by T+γ, the γ is detected as the color misregistration amount.

In order to detect the color misregistration amount, the CPU 200 functions as a gravity center position calculation unit 201, an asymmetry calculation unit 202, a correction amount acquisition unit 203, and a color misregistration amount determination unit 204. The first ROM 240 is a non-volatile memory for storing correction amounts, which are calculated in advance, of the formation position of the measurement image. The second ROM 250 is a non-volatile memory for storing color misregistration amounts, which are calculated by the color misregistration amount determination unit 204 in advance, of the measurement images of respective colors. The first ROM 240 and the second ROM 250 are constructed by different non-volatile memories, but may be constructed in different storage regions in a single non-volatile memory. The laser scanning unit 260 controls operations of the laser scanners 13*a* to 13*d* to correct, for example, formation positions of the electrostatic latent images and densities of images to be formed. The gravity center position calculation unit 201 may be constructed by another processor which is different from, for example, the application-specific integrated circuit (ASIC) or the CPU 200. Similarly, the asymmetry calculation unit 202, the correction amount acquisition unit 203, and the color misregistration amount determination unit 204 may also be constructed by another processor which is different from, for example, the ASIC or the CPU 200.

Position Detection Processing

Figure 6A:
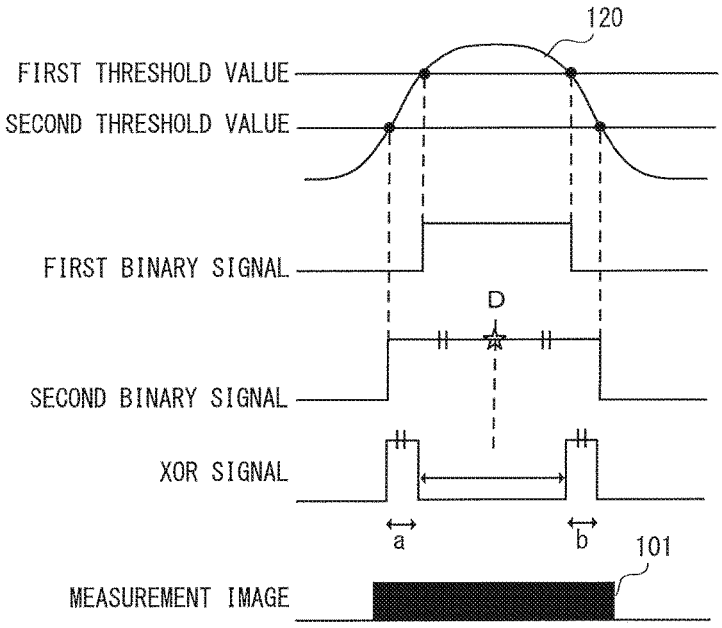
FIG. 6A and FIG. 6B are explanatory diagrams for illustrating position detection processing for a measurement image.
Figure 6B:
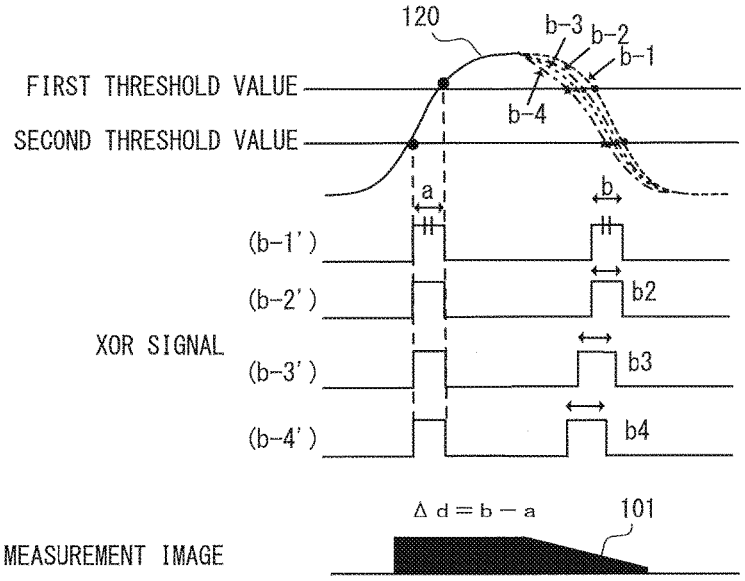

FIG. 6A and FIG. 6B are explanatory diagrams for illustrating position detection processing for the measurement image of the above-mentioned controller 80. FIG. 6A is an explanatory diagram for illustrating position detection processing in the case in which the measurement image 101 has an even image density. FIG. 6B is an explanatory view for illustrating position detection processing in the case in which the image density is changed at the rear end of the measurement image 101.

The detection waveform 120 of the analog signal output from the photo sensor 100 is converted into the first binary signal by the first comparator 210. Further, the detection waveform 120 is converted into the second binary signal by the second comparator 220. The XOR unit 230 performs the exclusive OR operation with the first binary signal and the second binary signal to generate the XOR signal. The XOR signal has two high regions. The two high regions are generated in order to binarize the detection waveform 120 with the first threshold value and the second threshold value being different values for the first comparator 210 and the second comparator 220 (herein, first threshold value>second threshold value). The high region of the XOR signal which appears in the rising region of the detection waveform 120 is referred to as a region a, and the high region of the XOR signal which appears in the falling region is referred to as a region b.

The region a represents a time period in which the detection waveform 120 rises from the second threshold value and reaches the first threshold value, and the region b represents a time period in which the detection waveform 120 falls from the first threshold value and reaches the second threshold value. The region a and the region b exhibit symmetry of the detection waveform 120. When the measurement image 101 having no change in density is detected as illustrated in FIG. 6A, the detection waveform 120 is symmetrical. Therefore, the lengths (time periods) of the region a and the region b are equal to each other. When the symmetry of the detection waveform 120 is impaired, the asymmetry is expressed by (b−a) with the region a as a reference. That is, the asymmetry is expressed by the difference Δd=b−a. The formation position (gravity center position D) of the measurement image 101 detected from the detection waveform 120 is located at an intermediate position between the rising edge and the falling edge of the first binary signal or the second binary signal. In FIG. 6A, the gravity center position D is detected based on the second binary signal.

In the case of the measurement image 101 in which the image density at the rear end is changed (reduced) as illustrated in FIG. 6B, the waveform of the detection waveform 120 in the falling region is changed. The detection waveform (b-1) expresses the same measurement result of the measurement image 101 as in FIG. 6A. The detection waveform (b-2) expresses the measurement result of the measurement image 101 in which the image density at the rear end is reduced by 30%. The detection waveform (b-3) expresses the measurement result of the measurement image 101 in which the image density at the rear end is reduced by 50%. The detection waveform (b-4) expresses the measurement result of the measurement image 101 in which the image density at the rear end is reduced by 80%.

The XOR (b-1') expresses an output signal of the XOR unit 230 based on the detection waveform (b-1). The XOR signal (b-2') expresses an output signal of the XOR unit 230 based on the detection waveform (b-2). The XOR signal (b-3') expresses an output signal of the XOR unit 230 based on the detection waveform (b-3). The XOR signal (b-4') expresses an output signal of the XOR unit 230 based on the detection waveform (b-4).

Even when the image density on the rear end side is changed, a size of the measurement image 101 is not changed. Therefore, the change in image density on the rear end side does not affect the starting point of the rise and the starting point of the fall in the detection waveform 120. Thus, the starting point of the fall in the detection waveforms (b-1) to (b-4) do not change, and there occurs a difference in the amount of fall from the start of fall.

According to comparison of the XOR signals (b-1') to (b-4'), there is no change in the region a. The region b is changed in accordance with the change in image density on the rear end side. Along with the increase in amount of change in image density on the rear end side of the measurement image 101, the region b becomes longer in the order of from the XOR signal (b-2') to the XOR signal (b-4'). With reference to FIG. 6B, the relationship of b<b2<b3<b4 is given. Thus, the difference Δd with the region b is detected with the region a which is not affected by the change in image density on the rear end side of the measurement image 101, thereby being capable of detecting the influence on the detection waveform by the change in image density on the rear end side of the measurement image 101. FIG. 6B is an illustration of the case in which the image density on the rear end side of the measurement image 101 is reduced. When the image density is larger on the rear end side, the region b is shortened. Also in this case, similarly to the case in which the image density is reduced, the influence on the detection waveform by the change in image density on the rear end side of the measurement image 101 can be detected through detection of the difference Δd.

The first ROM 240 stores in advance a table being information representing a relationship between the difference Δd of the region b and the region a and a correction amount α of an error of the formation position of the measurement image which is determined in advance in accordance with an amount of error between the gravity center position D based on the second binary signal and the actual formation position of the measurement image 101. FIG. 7 is an example of the table stored in the first ROM 240.

The CPU 200 refers to the first ROM 240 and acquires the correction amount α in accordance with the difference Δd between the region a and the region b of the XOR signal acquired from the detection waveform 120 of the measurement image 101. The CPU 200 adds the correction amount α to the gravity center position D detected from the second binary signal, thereby being capable of determining the actual formation position X from the detection waveform 120 of the measurement image 101, even when the measurement image 101 is changed in density at the end portion. That is, the CPU 200 calculates the actual formation position X of the measurement image 101 with the following Expression 1.

$$X=D+\alpha \qquad \text{Expression 1}$$

Therefore, the gravity center position calculation unit 201 calculates the gravity center position D of the second binary signal. The asymmetry calculation unit 202 calculates the difference Δd between the region b and the region a of the XOR signal. The correction amount acquisition unit 203 acquires the correction amount α in accordance with the difference Δd by referring to the first ROM 240. The color misregistration amount determination unit 204 determines the actual formation position X with the above-mentioned Expression 1. The CPU 200 calculates the color misregistration amounts γ of the measurement images of respective colors in accordance with the actual formation positions X for the respective colors. The CPU 200 controls the laser scanning unit 260 in accordance with the calculated color misregistration amounts γ for respective colors and adjusts writing start positions of the laser scanners 13*a* to 13*d*, to thereby perform the color misregistration correction. For example, the CPU 200 corrects relative positions of the yellow image and images of other colors based on the color misregistration amount γ. The measurement image 101 has a rectangular shape in this embodiment. However, the measurement image 101 may have a V-shape. Further, in the measurement image 101, along side thereof is orthogonal to the conveyance direction. However, for example, the long side may take a predetermined angle with respect to the conveyance direction. The measurement image 101 may have any shape as long as the measurement image has a well-known configuration.

Figure 8:
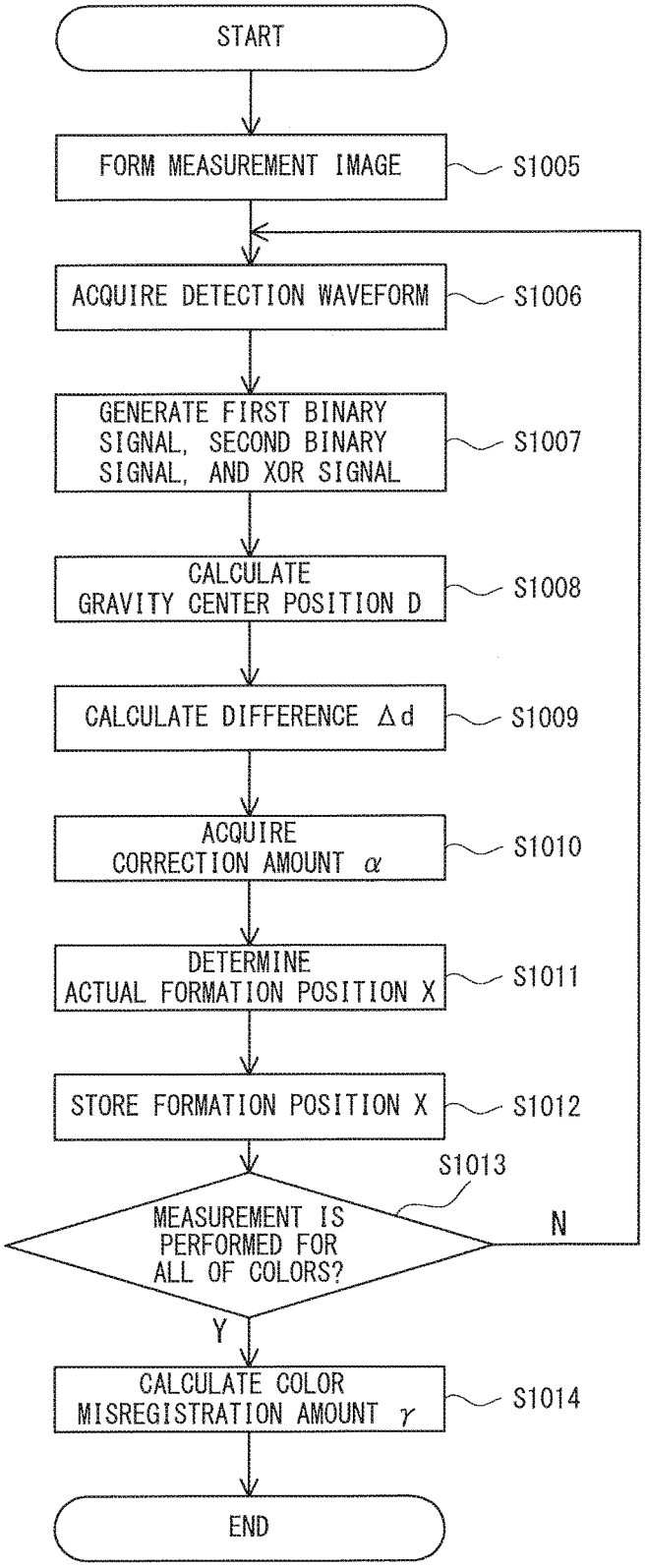
FIG. 8 is a flowchart for illustrating calculation processing for a color misregistration amount.

FIG. 8 is a flowchart for illustrating calculation processing for a color misregistration amount by the image forming apparatus having the configuration described above.

The controller 80 controls the image forming unit 10 to form the measurement images of respective colors Y, M, C, and K on the intermediate transfer belt 31 (Step S1005). The measurement images of respective colors Y, M, C, and K are sequentially formed on the intermediate transfer belt 31, for example, in the order described with reference to FIG. 2. The controller 80 sequentially acquires the detection waveforms of the measurement images of respective colors from the photo sensors 100 in accordance with rotation of the intermediate transfer belt 31 (Step S1006). In this embodiment, the controller 80 acquires detection waveforms in the order of Y, M, C, and K. The following processing is performed every time the detection waveforms of the measurement images of respective colors are acquired.

The controller 80 converts the detection waveform into the first binary signal and the second binary signal through the first comparator 210 and the second comparator 220. The first binary signal is input to the XOR unit 230. The second binary signal is input to the XOR unit 230 and to the CPU 200. The XOR unit 230 generates the XOR signal in accordance with the first binary signal and the second binary signal (Step S1007). The XOR signal is input to the CPU 200.

The CPU 200 controls the gravity center position calculation unit 201 to calculate the gravity center position D in accordance with the second binary signal (Step S1008). The CPU 200 controls the asymmetry calculation unit 202 to calculate the difference Δd between the region a and the region b in accordance with the XOR signal (Step S1009). The CPU 200 controls the correction amount acquisition unit 203 to acquire the correction amount α in accordance with the difference Δd by referring to the first ROM 240 (Step S1010). The CPU 200 controls the color misregistration amount determination unit 204 to determine the actual formation position X of the measurement image with the above-mentioned Expression 1 based on the acquired correction amount α and the gravity center position D (Step S1011). The CPU 200 stores the determined actual formation position X of the measurement image in the second ROM 250 (Step S1012).

The CPU 200 terminates measurement of the measurement images of all of the colors Y, M, C, and K and determines whether or not the actual formation positions X of the measurement images of all of the colors are stored in the second ROM 250 (Step S1013). When the measurement of the measurement images of all of the colors is not terminated (Step S1013: N), the controller 80 repeatedly performs the processing subsequent to Step S1006. When the measurement of the measurement images of all of the colors is terminated (Step S1013: Y), the CPU 200 calculates the color misregistration amounts γ of the respective colors based on the actual formation positions X of the measurement images of all of the colors (Step S1014). The controller 80 performs the color misregistration correction based on the calculated color misregistration amounts γ for the respective colors.

As described above, with the image forming apparatus according to this embodiment, even when the measurement image is changed in image density at the end portion, the color misregistration of the measurement images of respective colors can be accurately detected through detection of a degree of change in density in accordance with the asymmetry of the XOR signal and consideration of the correction amount in accordance with the degree of change in density. Therefore, the color misregistration correction can be performed with high accuracy in the image forming apparatus. In this embodiment, the color misregistration correction amount X is calculated based on the gravity center position D of the second binary signal. However, the color misregistration correction amount X can be calculated through similar processing using the gravity center position of the first binary signal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-201618, filed Oct. 13, 2016 which is hereby incorporated by reference herein in its entirety.

What is claimed is:

1. An image forming apparatus, which is configured to form an image on a sheet, comprising:

a plurality of image forming units configured to form a plurality of images, each having a different color;

a sensor configured to measure reflected light from a color pattern formed on a transfer member, the color pattern being used for detection of a color misregistration amount;

a first comparator configured to compare a measurement value of the sensor with a first threshold value;

a second comparator configured to compare the measurement value of the sensor with a second threshold value being different from the first threshold value; and a controller configured to control the plurality of image forming units to form, on the transfer member, a plurality of color patterns, each having a different color, control the sensor to measure reflected light from the plurality of color patterns, cause the first comparator to compare measurement values of reflected light from the plurality of color patterns with the first threshold value to acquire first data, cause the second comparator to compare the measurement values of reflected light from the plurality of color patterns with the second threshold value to acquire second data, detect the color misregistration amount related to relative position of a color pattern having a reference color among the plurality of color patterns and a color pattern having another color among plurality of color patterns based on the first data and the second data, and determine an image forming condition for adjusting an image forming position of an image having other color different from the reference color based on the color misregistration amount, wherein the controller generates correction data based on the first data and the second data, and detects the color misregistration amounts based on the second data and the correction data, wherein the first data corresponds to a binary digital signal, wherein the second data corresponds to a binary digital signal, wherein the controller determines third data corresponding to an exclusive OR of the first data and the second data, and generates the correction data based on the third data, and wherein the third data corresponds to a binary digital signal.

2. The image forming apparatus according to claim 1, wherein the third data includes a period in which a binary digital signal value corresponds to a predetermined signal value and a period in which the binary digital signal value corresponds to another signal value different from the predetermined signal value, and wherein the controller generates the correction data based on the period corresponding to the predetermined signal value.

3. The image forming apparatus according to claim 2, wherein the period in which the binary digital signal value of the third data corresponds to the predetermined signal value includes a first period and a second period for each color pattern, and wherein the controller generates the correction data for each color pattern based on the first period and the second period.

4. The image forming apparatus according to claim 1, wherein the controller determines position data related to a gravity center position of the second data, corrects the position data based on the correction data, and detects the color misregistration amounts based on the corrected position data.

5. The image forming apparatus according to claim 2, wherein the controller determines the position data based on a rising edge of the second data and a falling edge of the second data.

6. The image forming apparatus according to claim 1, wherein the controller generates correction data corresponding to the color pattern having the reference color based on first data corresponding to the color pattern having the reference color and second data corresponding to the color pattern having the reference color, and wherein the controller generates correction data corresponding to the color pattern having the other color based on first data corresponding to the color pattern having the other color and second data corresponding to the color pattern having the other color.

7. The image forming apparatus according to claim 1, wherein the sensor includes a light emitting element and a light receiving element configured to receive diffused reflected light from the transfer member.

8. The image forming apparatus according to claim 1, wherein the second threshold value corresponds to a value between a measurement value of reflected light from the transfer member given by the sensor and the first threshold value.

9. A position detection method, which is performed by an image forming apparatus configured to form an image on a sheet, the image forming apparatus comprising:

a plurality of image forming units configured to form a plurality of images, each having a different color;

a sensor configured to measure reflected light from a color pattern formed on a transfer member, the color pattern being used for detection of a color misregistration amount; and a controller, the position detection method being performed by the controller and comprising:

controlling the plurality of image forming units to form, on the transfer member, a plurality of color patterns, each having a different color;

controlling the sensor to measure reflected light from the plurality of color patterns;

comparing measurement values of reflected light from the plurality of color patterns with a first threshold value to acquire first data;

comparing the measurement values of reflected light from the plurality of color patterns with a second threshold value being different from the first threshold value to acquire second data;

generating correction data based on the first data and the second data;

detecting the color misregistration amount related to relative position of a color pattern having a reference color among the plurality of color patterns and a color pattern having another color among plurality of color patterns based on the second data and the correction data; and determining an image forming condition for adjusting an image forming position of an image having other color different from the reference color based on the color misregistration amount, wherein the first data corresponds to a binary digital signal, wherein the second data corresponds to a binary digital signal; and the position detection method further comprising determining third data corresponding to an exclusive OR of the first data and the second data, and generating the correction data based on the third data, and wherein the third data corresponds to a binary digital signal.

* * * * *